US008857309B2

(12) United States Patent
Wentzel

(10) Patent No.: US 8,857,309 B2
(45) Date of Patent: Oct. 14, 2014

(54) METHOD AND DEVICE FOR PROTECTING OBJECTS AGAINST ROCKET PROPELLED GRENADES (RPGS)

(76) Inventor: Cyril Maurice Wentzel, The Hague (NL)

( * ) Notice: Subject to any disclaimer, the term of this patent is extended or adjusted under 35 U.S.C. 154(b) by 548 days.

(21) Appl. No.: 12/520,150

(22) PCT Filed: Dec. 21, 2007
(Under 37 CFR 1.47)

(86) PCT No.: PCT/NL2007/050679
§ 371 (c)(1),
(2), (4) Date: Mar. 23, 2010

(87) PCT Pub. No.: WO2008/079001
PCT Pub. Date: Jul. 3, 2008

(65) Prior Publication Data

US 2010/0294124 A1 Nov. 25, 2010

(30) Foreign Application Priority Data

Dec. 22, 2006 (NL) ..... 2000406

(51) Int. Cl.
*F41H 5/06* (2006.01)
*F41H 5/02* (2006.01)

(52) U.S. Cl.
CPC ..... *F41H 5/026* (2013.01)
USPC ..... 89/36.01; 89/918

(58) Field of Classification Search
USPC ..... 89/36.01, 36.02, 36.07, 918, 920, 939; 114/241, 240 E, 240 R, 240 D
See application file for complete search history.

(56) References Cited

U.S. PATENT DOCUMENTS

| | | | | |
|---|---|---|---|---|
| 1,204,547 | A * | 11/1916 | Doyle | 114/241 |
| 1,286,261 | A | 12/1918 | Elida | 114/9 |
| 1,337,920 | A * | 4/1920 | Kohler | 114/240 R |
| 1,385,897 | A | 7/1921 | Tresidder | 114/9 |
| 1,657,915 | A | 1/1928 | Calamita | 114/9 |
| 2,323,853 | A | 7/1943 | Simeone | 114/9 |
| 2,326,713 | A | 8/1943 | Wesseler | |
| 2,697,054 | A | 12/1954 | Dietz et al. | 428/110 |
| 2,954,964 | A | 10/1960 | O'Haffey | 256/34 |
| 3,069,796 | A | 12/1962 | Rüter et al. | 428/17 |

(Continued)

FOREIGN PATENT DOCUMENTS

| | | |
|---|---|---|
| DE | 218246 | 1/1910 |
| DE | 691067 | 5/1940 |

(Continued)

OTHER PUBLICATIONS

Written Opinion of the European Patent Office in counterpart foreign application No. PCT/NL2007/050679 filed Dec. 21, 2007.

(Continued)

*Primary Examiner* — Reginald Tillman, Jr.
(74) *Attorney, Agent, or Firm* — Steven M. Koehler; Westman, Champlin & Koehler, P.A.

(57) ABSTRACT

A device and a method for protecting objects against rocket-propelled grenades having a hollow nose cone includes a netting of knotted and coated superstrong fibers disposed in front of the object, in such a manner that the nose cone of a rocket caught in the netting will penetrate one of the meshes of the netting and be deformed through strangulation, thereby disabling the detonator.

15 Claims, 2 Drawing Sheets

(56) References Cited

U.S. PATENT DOCUMENTS

| | | | | |
|---|---|---|---|---|
| 3,129,632 | A * | 4/1964 | Starr | 87/12 |
| 3,586,236 | A | 6/1971 | Schaffler | 239/172 |
| 3,769,142 | A | 10/1973 | Holmes et al. | 428/113 |
| 3,942,598 | A | 3/1976 | Council | 180/6.5 |
| 3,964,197 | A | 6/1976 | Tucker et al. | 40/584 |
| 3,969,563 | A | 7/1976 | Hollis, Sr. | 428/175 |
| 3,995,525 | A | 12/1976 | Blair | 86/22 |
| 4,186,817 | A | 2/1980 | Bauer | 180/68.1 |
| 4,230,041 | A | 10/1980 | Bailey et al. | 102/275.8 |
| 4,312,272 | A | 1/1982 | Baker et al. | 102/275.8 |
| 4,378,725 | A * | 4/1983 | Hospers et al. | 87/12 |
| 4,512,256 | A | 4/1985 | Schriber et al. | |
| 4,787,289 | A | 11/1988 | Duer | 273/410 |
| 4,882,764 | A | 11/1989 | Reynolds et al. | |
| 4,934,245 | A | 6/1990 | Musante et al. | 89/36.02 |
| 5,069,109 | A | 12/1991 | Lavan, Jr. | |
| 5,223,664 | A | 6/1993 | Rogers | 102/275.1 |
| 5,412,577 | A | 5/1995 | Sainio et al. | |
| 5,524,694 | A | 6/1996 | Arapis | 160/370.21 |
| 6,363,867 | B1 | 4/2002 | Tsilevich | 109/49.5 |
| 6,481,782 | B2 | 11/2002 | Bond | 296/187.07 |
| 6,568,310 | B2 | 5/2003 | Morgan | 89/36.02 |
| 6,626,077 | B1 | 9/2003 | Gilbert | 89/1.11 |
| 6,647,855 | B1 | 11/2003 | Christiansen et al. | 89/36.01 |
| 6,843,197 | B1 | 1/2005 | Nixon et al. | 114/241 |
| 6,918,349 | B2 | 7/2005 | Andersson et al. | 114/382 |
| 6,973,864 | B1 | 12/2005 | Ahmad | 89/36.02 |
| 7,073,538 | B2 | 7/2006 | Bhatnagar et al. | 139/383 R |
| 7,076,898 | B1 | 7/2006 | Hunt | 40/611.01 |
| 7,100,490 | B2 * | 9/2006 | Muller, Jr. | 89/36.02 |
| 7,415,917 | B2 * | 8/2008 | Lloyd | 102/473 |
| 7,827,900 | B2 * | 11/2010 | Beach et al. | 89/36.17 |
| 7,866,250 | B2 | 1/2011 | Farinella et al. | 89/36.17 |
| 7,900,548 | B2 * | 3/2011 | Hoadley et al. | 89/36.17 |
| 7,975,594 | B2 | 7/2011 | Wartmann | 89/36.02 |
| 8,006,605 | B2 | 8/2011 | Tunis et al. | 89/36.02 |
| 8,011,285 | B2 | 9/2011 | Farinella et al. | 89/36.08 |
| 8,061,258 | B2 | 11/2011 | Hoadley et al. | 89/36.17 |
| 2004/0221712 | A1 | 11/2004 | Stewart et al. | 89/36.05 |
| 2005/0262998 | A1 | 12/2005 | Ahmad | 89/36.02 |
| 2006/0014920 | A1 | 1/2006 | Shirakawa et al. | 528/272 |
| 2006/0065111 | A1 | 3/2006 | Henry | 89/36.02 |
| 2006/0144640 | A1 | 7/2006 | Wartmann | 182/138 |
| 2006/0169832 | A1 | 8/2006 | Glasson | |
| 2007/0099526 | A1 | 5/2007 | Heerden et al. | 442/135 |
| 2007/0131917 | A1 | 6/2007 | Wartmann | 256/12.5 |
| 2007/0180983 | A1 * | 8/2007 | Farinella et al. | 89/36.07 |
| 2007/0210214 | A1 | 9/2007 | Wartmann | 245/5 |
| 2007/0261542 | A1 | 11/2007 | Chang et al. | 89/1.11 |
| 2008/0307553 | A1 | 12/2008 | Jbeili et al. | 2/2.5 |
| 2009/0173250 | A1 | 7/2009 | Marscher et al. | 102/438 |
| 2009/0217811 | A1 * | 9/2009 | Leeming | 89/36.02 |
| 2009/0308238 | A1 * | 12/2009 | Schwartz | 89/36.02 |

FOREIGN PATENT DOCUMENTS

| | | | |
|---|---|---|---|
| DE | 2507351 | A1 | 9/1973 |
| DE | 2409876 | A1 | 9/1975 |
| DE | 2507351 | | 9/1976 |
| DE | 3337115 | A1 | 2/1988 |
| GB | 514577 | A | 11/1939 |
| GB | 517911 | A | 2/1940 |
| GB | 518338 | A | 2/1940 |
| GB | 2449055 | | 11/2008 |
| GB | 2449055 | | 12/2008 |
| JP | 4136699 | | 5/1992 |
| RU | 2125224 | | 1/1999 |
| RU | 2199711 | | 2/2003 |
| RU | 2199711 | C2 | 2/2003 |
| WO | 9200496 | A1 | 6/1990 |
| WO | 2006135432 | A2 | 12/2006 |
| WO | WO 2006/135432 | | 12/2006 |
| WO | WO 2008/063205 | | 5/2008 |
| WO | 2008079001 | A1 | 7/2008 |

OTHER PUBLICATIONS

Official Search Report of the European Patent Office in counterpart foreign application No. PCT/NL2007/050679 filed Dec. 21, 2007.

Huntiller M: "Asymmetrical Warfar-Armous" Armada International, Zurck, CH, vol. 28 No. 6, Dec. 2004, pp. 38-40, 42.

Search report dated Jun. 18, 2007 for corresponding European patent application published as EP 1944565.

J. Lok, "Grenade Catcher," Defense Technology international, pp. 14-16, Jun. 2007.

"Dyneema." Wikipedia, The Free Encyclopedia. Wikimedia Foundation, Inc.. Nov. 10, 2005. Web. Jul. 12, 2005. <http://en.wikipedia.org/wiki/Dyneema>.

"Ultra High Molecular Weight Polyethylene." Wikipedia, The Free Encyclopedia. Wikimedia Foundation, Inc.. Nov. 5, 2005. Web. Jul. 12, 2005. <http://en.wikipedia.org/wiki/ultra_molecular_weight_polyethylene>.

Janssen, Joris. "Greenade Catcher." Defense Technology International. Web. Jun. 2007. <www.aviationweek.com/dti>.

European Patent Office Notice of Opposition in European Application No. EP07851939.4, received Jan. 20, 2012.

Response to Notice of Opposition in European Patent Application No. EP07851939.4, dated May 18, 2012.

Communication from European Patent Office in European Patent Application No. EP07851939.4, dated Feb. 29, 2012.

Communication from European Patent Office in European Patent Application No. EP07851939.4, dated Jan. 26, 2012.

* cited by examiner

METHOD AND DEVICE FOR PROTECTING OBJECTS AGAINST ROCKET PROPELLED GRENADES (RPGS)

CROSS-REFERENCE TO RELATED APPLICATION

The present application is a national stage filing of International patent application Serial No. PCT/NL2007/050679, filed Dec. 21, 2007, and published as WO 2008/079001 in English.

BACKGROUND

The discussion below is merely provided for general background information and is not intended to be used as an aid in determining the scope of the claimed subject matter.

Aspects of the invention relate to a method and a device for protecting objects against rocket-propelled grenades (RPGs) having a hollow nose cone. Another aspect relates to an armoured vehicle provided with armour plating and with such a device, as well as to the use of such a device for protecting a fortified military post, for example. Yet another aspect of the invention relates to a method for manufacturing such a device.

RPGs, in particular the RPG7, are rocket weapons that have been spread in very large numbers all over the world since the sixties. Such weapons are especially used in so-called asymmetric warfare, i.e. in combats between armies having armoured vehicles and/or tanks and groups mainly armed with hand-held weapons. An RPG7 rocket is a very effective weapon against armoured vehicles, its hollow charge enabling it to penetrate more than 250 mm thick armour plating. Such weapons are also used against buildings.

The RPG7 is a rocket having a hollow nose cone, whose inner side functions as part of the detonation circuit of a detonator, which must detonate the hollow charge upon impact of the rocket with an object.

In the past several attempts have been made to provide a protection device. Thus RU 2 125 224 discloses a shield for a tank or a combat vehicle, in which use is made of a single-layer or multilayer netted or grid shield made of steel wire or bars. The shields are mounted to the four sides of the tank or the combat vehicle via parallelogram mechanisms, which enable the shields to take up a combat position or a travelling position. In the combat position, the shield is spaced from the armour plating by a distance of up to 2-3 m, whilst in a travelling position the shield is disposed quite close to the armour plating. Such a shield has proven not to be very effective in practice, whilst the shields add significantly to the weight of the tank.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

An aspect of the invention provides a method for protecting objects against rocket-propelled grenades having a hollow nose cone, wherein a netting of, in one embodiment knotted and coated, superstrong fibers is disposed in front of the object, wherein the size of the meshes of the netting has been selected so that a nose cone of a rocket caught in the netting will penetrate one of the meshes of the netting and be deformed through strangulation, thereby disabling the detonator.

Another aspect of the invention further provides a device for protecting object against rocket-propelled grenades, comprising a netting of superstrong fibers, which can be knotted and provided with a flexible coating, formed with a number of meshes having a stretched mesh length of maximally about 8 cm.

By using knotted netting of superstrong fibers, a protection device which can have a low weight is obtained. Dyneema® (ultra high molecular weight polyethylene) may be used as the superstrong fiber, but it is also conceivable to use other known fibers, such as aramid and Spectra® (ultra high molecular weight polyethylene). Also combinations of materials are possible. To obtain high knot strength, it is advantageous to coat the fibers with a flexible material, for example comprising moisture-resistant and elastomeric components, such as PUR (polyurethane). Such netting makes it possible to exert a so-called strangulation effect on the nose cone of the grenade, so that the grenade is caught and directly disabled due to the short-circuit that is caused in the detonator circuit extending through the nose cone, as a result of which no signal transfer can take place from the piezo-electric sensor in the nose to the detonator. The grenade can thus be deactivated in the course of a very short distance, making it possible to dispose the netting quite close to the object.

Such a strangulation effect can be achieved in an effective manner by using a stretched mesh length of preferably maximally 8 cm and preferably minimally 7 cm.

It is advantageous if the netting is pre-stretched after being knotted, preferably after being coated, preferably with a force such that the fibers are loaded to a tension of about 0.2 to 0.5 times the breaking stress of the knots. In this way the amount of slip that occurs at the knots during said strangulation can be minimised.

It is advantageous in that case if the netting is so configured that the meshes are capable of withstanding a circumferential load of minimally about 3 kN, whilst the mesh legs preferably have a diameter of maximally about 4 mm.

With the aforesaid minimum circumferential load, those forces that occur upon strangulation of a grenade penetrating the meshes can be sufficiently withstood to enable strangulation of the nose cone. In one embodiment, the smallest possible mesh leg diameter is used, because this minimises the chance that the hollow charge of the grenade is still detonated by the impact of the grenade with a mesh leg or a knot of the netting. Equilibrium needs to be found between the strength of the netting and the thickness of the fibers used therein.

In a special embodiment, in which the meshes are formed by at least three mesh sides, each mesh side is made up of at least two separate fibers, which can extend at least substantially parallel to each other. In this embodiment only one of the two fibers of each mesh side functions as a spare fiber in case the other fiber should break upon impact or during strangulation of the grenade. In this way an even more reliable operation can be realised. The fibers can extend parallel to each other, because this reduces the risk of the grenade detonating on the mesh legs of the net or of the two fibers breaking simultaneously.

In order to further enhance the deformation of the nose cone for the purpose of disabling the detonator of the grenade, the meshes may be provided with projections 11, such as beads, between the knots thereof. Such projections 11 cause a local deformation of the nose cone, so that a short-circuit will occur even sooner. Such projections make it possible to use comparatively larger meshes and thus reduce the risk of the detonator detonating on the netting, or on the other hand to cause a short-circuit sooner, making it possible to dispose the netting closer to the object to be protected.

In another special embodiment the device is provided with two nettings disposed one behind the other, perpendicular to the plane thereof. In this case the second netting, seen in the direction of movement of the grenade, functions as spare netting in case the first netting should fail. Depending on the application, the nettings can be so disposed that the meshes of the two nettings are aligned, but in other cases it may be advantageous for the nettings to be staggered relative to each other.

To increase the knot strength and prevent slip in the knots of the netting it may be advantageous if each knot is a double knot. Also in this case equilibrium will have to be found between increasing the risk of the hollow charge detonating on the knot and realising less slip in the knots and thus increasing the chance of a successful strangulation of the nose cone of a grenade.

A special application of the device according to an aspect of the invention is on an armoured vehicle, in which case the device comprises means of attachment for disposing the netting at the distance of about 15-50 cm from the armour plating. Such a small spacing can be achieved as a result of the good strangulation effect provided by the device, and such a small spacing has a positive effect on the vehicle characteristics, of course. Such a small spacing will hardly affect the appearance of the vehicle, whilst in addition the serviceability of the vehicle will not be adversely affected to any significant extent.

Consequently an aspect of the invention also relates to an armoured vehicle provided with armour plating and with a device as described in the foregoing, comprising means of attachment for disposing the netting of the device at a distance of about 15-50 cm from the armour plating.

The aforesaid spacing between the netting and the armour plating can be maintained in a simple manner if a foam material or an air cushion is placed between the vehicle and the netting, and the netting is stretched against the foam material or the air cushion. In this way the netting can be attached to the vehicle in a simple manner without adding to the weight of the vehicle to any significant extent. In practice it has become apparent that the inertia forces of the netting itself are so large that means of attachment are hardly needed, if at all, for keeping the netting in place upon impact of a grenade.

Although the device can function in a fully passive manner, at least part of the device may also play an active part, for example if the air cushion is inflatable and comprises one or more sensors for detecting an acute threat and causing the air cushion to inflate prior to the impact of a grenade. In that case the netting is not positioned at the desired distance from the armour plating until just before the grenade impacts, so that the netting can be disposed even closer to the armour plating in an inactive position.

Another application of the device is to protect a fortified military post, such as an observation tower or observation post, an ammunition depot or the like, wherein the netting is suspended from a frame at its circumference, or at least at the upper side and possibly at the bottom side, at a distance of at least 50 cm, and preferably about 1-2 m, from the object to be protected, for example a fortification thereof or therefor. With such an application, the spacing between the netting and the object to be protected is less critical, so that the need to deactivate the grenade within a very short distance is less urgent in this embodiment.

Another aspect of the invention further relates to a method for manufacturing netting for use as a protection against RGPs, comprising the steps of forming the knotted netting from superstrong fibers, impregnating the obtained netting with a flexible coating, allowing the coating to dry and pre-stretching the knotted netting.

In practice it has become apparent that a very great knot strength exhibiting very little slip can be obtained if the netting is pre-stretched, and the knots are therefore tightened after the coating has dried rather than before said drying, as is usual. It can be preferable to tension and pre-stretch the netting a number of times, for example three times, since the extent of slip can be reduced even further in this manner.

BRIEF DESCRIPTION OF THE DRAWINGS

Aspects of the invention will be explained in more detail hereinafter with reference to the drawings, which very schematically show embodiments of the invention.

DETAILED DESCRIPTION OF THE ILLUSTRATIVE EMBODIMENTS

Figure 2:
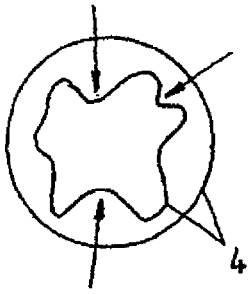
FIG. 2 is a sectional view along the line II-II in FIG. 1, in which the nose cone is shown in the completely strangulated condition.
Figure 1:
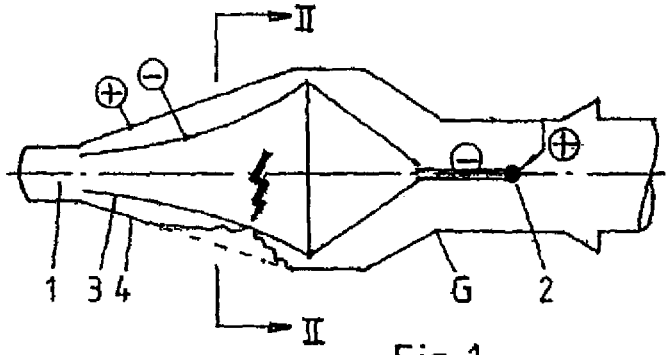
FIG. 1 is a longitudinal sectional view of an RPG7 rocket, in which the upper half shows the nose cone in undamaged condition and the lower half shows the nose cone in strangulated condition.

As already said before, FIGS. 1 and 2 very schematically show the construction principle of the detonation system of an RPG7. The figures show the piezo-electric impact sensor 1 in the nose of the grenade G, a detonator 2 of the hollow charge with a circuit path connected to the minus side of the detonator 2, such as a wire 3, and a nose cone 4 connected to the plus side of the detonator 2. FIG. 1 shows that it is possible to cause a short-circuit in the detonation circuit, thereby preventing detonation, by deforming the nose cone 4 of the grenade in such a manner that the coating applied to the inner side of the nose cone is broken, thereby exposing the metal of the nose cone, and subsequently making a short-circuit with the other pole in the detonation circuit. To that end it is necessary for the nose cone 4 to undergo a comparatively large local deformation, in which the cone is on the one hand deformed sufficiently far towards the inside to make contact with the circuit wire 3, whilst on the other hand the coating on the inner side of a nose cone is deformed sufficiently strongly to cause it to break.

Such a deformation of the nose cone 4 is shown in FIG. 2, in which a local deformation has been effected at three locations (indicated by arrows), which local deformation is large enough to break the coating at said locations and expose the metal of the cone. A short-circuit may subsequently be triggered at the aforesaid three locations.

Such a deformation can be effected by catching the nose cone 4 of an RPG in a mesh of netting, with the mesh sides or legs of the netting tightening round the nose cone 4 like a noose as the nose cone penetrates further into the mesh, thereby strangulating the nose cone, as it were, and causing it to deform. Such a strangulation effect can occur when a number of conditions are met. In the first place, the netting must offer sufficient resistance to the penetration of the grenade, but in most cases the mass inertia forces of the netting are sufficiently large to effect this. In the second place, a mesh cell must be sufficiently strong to withstand the forces being exerted thereon, i.e. both the mesh sides or legs and the knots. The strength of the mesh sides depends on the strength of the fibers used therefor, whilst the strength of the knots is mainly determined by the slip resistance thereof. The size of the meshes is preferably large enough that the nose cone can easily penetrate the mesh and small enough that the largest diameter of the cone of the rocket is larger than the diameter of the mesh.

Netting is provided having properties such that there is a relatively great chance that a grenade will be deactivated upon being caught. The netting is to that end made of a superstrong fiber, with Dyneema® (ultra high molecular weight polyethylene) being preferred, but also aramid, HDPE, Spectra® (ultra high molecular weight polyethylene) or PBO (polybenzobisoxazole) may be considered, for example. The fibers may be braided or laid up. In the case of braided fibers or rope, an aramid core may be provided, for example, which aramid core forms an anti-cut-through element, for example in case the nose cone of the grenade is externally provided with cutting blades. In would also possible to braid metal into the sheath of the braided rope. Preferably, the smallest possible diameter of the rope formed by the fibers is used so as to prevent detonation on the netting. In the case of a Dyneema® fiber a diameter of about 4 mm will suffice, for example, for withstanding a sufficiently large circumferential load on a mesh cell of minimally about 3 kN.

The circumferential load to be withstood is also determined by the knots of the netting. Said knots must have a high slip resistance, and this can be realised in particular by using a double knot. Such a double knot can be used successfully when the fiber diameter is relatively small, since the risk of detonation on a knot will be comparatively small in that case.

The amount of slip in a knot can be minimised by impregnating the netting with a coating comprising moisture-resistant and elastomeric components, such as PUR, Latex or a bitumen coating. Such a coating is multifunctional. It stabilises the knot, it increases the strength of the knots and the fibers, it reduces wear and enhances the weather resistance. It can also camouflage the netting if a colorant is incorporated in the coating. The amount of slip is minimised by tightening the knot with a force of about 0.2-0.5 times the breaking stress of the knot.

Figure 3:
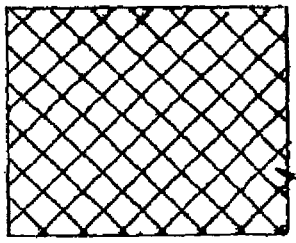
FIGS. 3 and 4 are front views of two possible embodiments of the netting of the device.
Figure 4:
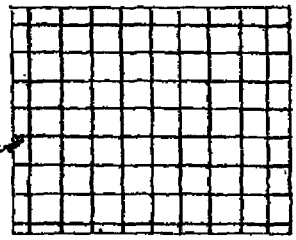

As FIGS. 3 and 4 show, the netting 5 may be of a diagonal type (FIG. 3) or of an orthogonal type (FIG. 4). The meshes may be square, but this is not necessary. The ratio of the number of meshes per unit length in two directions may range between 3:4 and 4:5, for example, resulting in a diamond shape to a greater or smaller extent.

Figure 5:
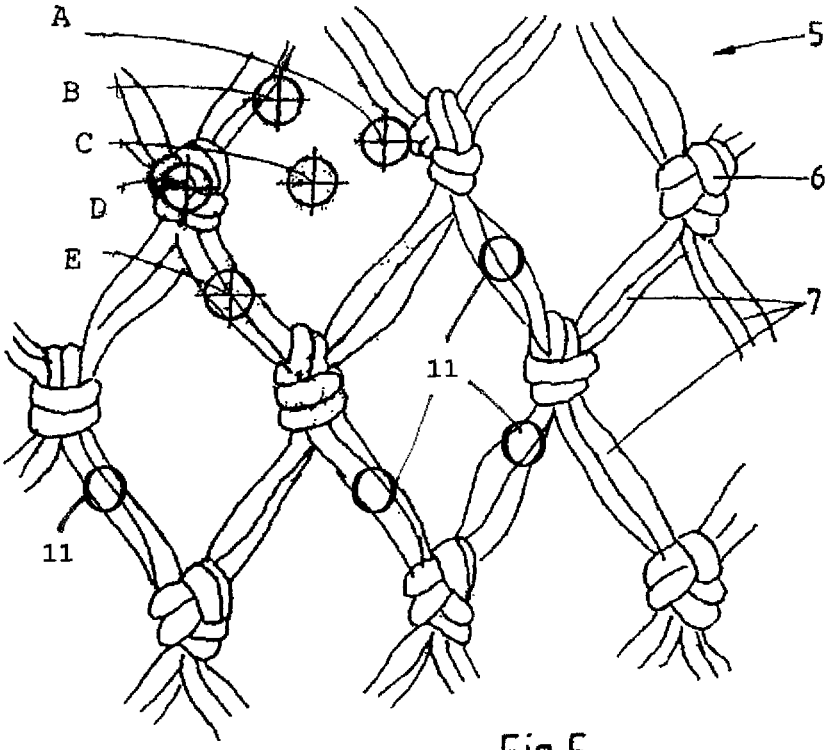
FIG. 5 is a larger-scale front view of an embodiment of the netting with possible hit locations of the nose of a grenade on the netting.

FIG. 5 shows the possible hit locations on netting 5. In the illustrated embodiment, so-called duplex netting is used, in which each leg 6 of a mesh between two knots 7 consists of two fibers or ropes, which can be untwisted and extend parallel to each other, therefore. Such duplex netting is especially advantageous in case of a subcritical hit on a leg of the mesh, when one of the two fibers is damaged and the other fiber can subsequently provide sufficient strength for strangulating the nose cone of the grenade.

Figure 6:
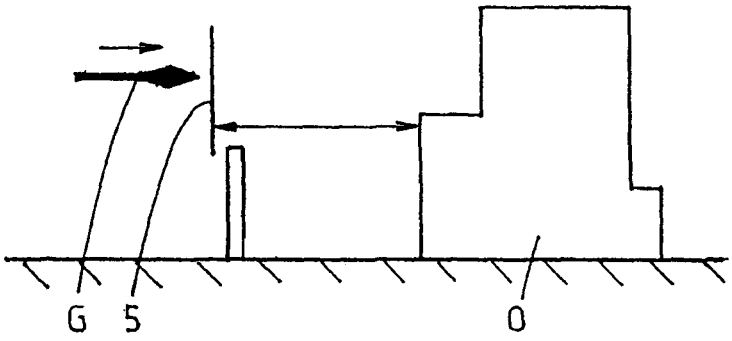
FIGS. 6, 7, 8 are very schematic views of three possible applications of the netting, viz. for protecting a building, for protecting an additionally fortified stationary object and for use on a mobile object, such as a vehicle or a vessel.
Figure 7:
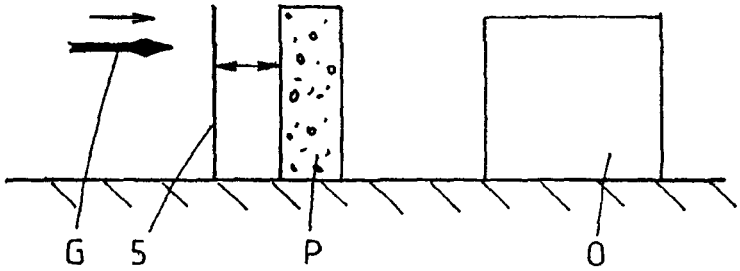
Figure 8:
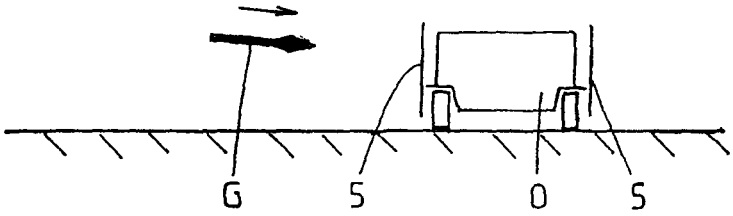

FIGS. 6-8 show three main applications of the device.

In the application shown in FIG. 6, the netting 5 of the device is disposed at a distance in the order of 10 m from the object O to be protected, for example a building. In this application the netting has a DON (Detonation on Net) function, to reduce the damage of the detonation (the force of the hollow charge rapidly decreases with distance), as a DUD, i.e. prevent detonation.

In the embodiment shown in FIG. 7, the netting 5 of the device is used in combination with protection means of the building, for example an ammunition depot or a military post. Additional protection means may consist of a protection wall P, for example a stone-filled grid wall. In this application the netting can be disposed a significantly smaller distance from, in this case, the additional protection wall, for example a distance in the order of 1-2 m. The netting also has a DON or a DUD function in this case.

In the embodiment shown in FIG. 8, the netting 5 primarily has a DUD function, and the netting is disposed very close to the object O to be protected, in particular to the armour plating of the object. In this application the objects mainly consists of mobile objects, in particular vehicles and vessels and other mobile modules. The netting may be disposed a very short distance from the object in that case, for example a distance in the order of 15-50 cm. The netting 5 may be disposed in front of the armour plating and as well as in front of the wheel housings to protect wheels, caterpillar tracks and the like.

Figure 9:
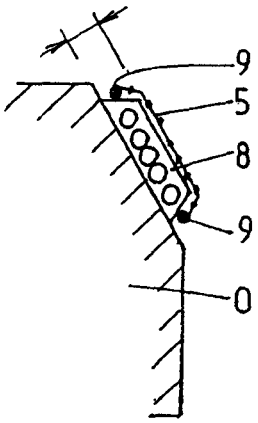
FIGS. 9 and 10 are very schematic views of two possible manners of attaching netting to a mobile object.

FIG. 9 shows a first possible way of attaching the netting of the device to the (armour plating of the) object. First a spacer is mounted to the object O, and subsequently the netting 5 is stretched over said spacer. The spacer may consist of a foam layer or an air cushion or the like, for example, which does not need to exhibit any strength of its own but which only functions to keep the netting in place. The netting may be frameless netting, therefore. The netting may be stretched over the spacer by means of bars 9 or other means of attachment, for example, but the net may also be integrated in the spacer, so that the spacer also functions as a means of attachment. The net may be hidden from view or be camouflaged by suitably selecting the spacer and the combination of the netting there with, so that it is unclear to attackers if and how the object is additionally protected. The nets may be provided over a large part of the surface area of the object or at critical places thereof. The netting can be disposed in such a manner that it can catch grenades being fired from different directions.

Figure 10:
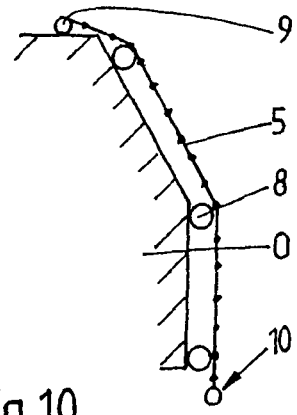

FIG. 10 shows a second embodiment, in which the object O consists of a hull of a ship. The netting may be suspended from the upper side of the ship's hull in this case, whilst spacers 8 again maintain the required spacing between the netting and the ship's hull. A weight 10 at the bottom side of the netting keeps the net properly stretched.

From the foregoing it will be understood that aspects of the invention provides a protection device that is remarkable for its effectiveness at a low weight. The device can be disposed a very short distance from the object to be protected, rendering it quite suitable for use with mobile objects.

The invention is not restricted to the embodiments as described above and shown in the drawings, which can be varied in several ways without departing from the scope of the invention.

Explanatory notes to FIG. 5 of the drawings regarding possible hit locations on the net:

A Edge of mesh

B Grazing leg

C Centre of mesh
D Centre of knot
E Centre of leg

The invention claimed is:

1. A method for protecting objects against rocket-propelled grenades (RPGs) having a hollow nose cone, comprising:

providing a netting of ultra high molecular weight polyethylene fibers, aramid fibers, polybenzobisoxazole fibers or combinations thereof wherein the netting is knotted and wherein a flexible coating is impregnated on the ultra high molecular weight polyethylene fibers, aramid fibers, polybenzobisoxazole fibers or combinations thereof and wherein the size of the meshes of the netting has been selected so that the nose cone of a rocket-propelled grenade caught in the netting will penetrate one of the meshes of the netting and be deformed through strangulation, thereby disabling the detonator and wherein the meshes are capable of withstanding a circumferential load of minimally about 3 kN; and disposing the netting in front of an object.

2. A device for protecting a fortified military post according to claim 1 and further comprising a frame configured to suspend the netting at least at the upper side and the bottom side thereof.

3. The method of claim 1 and wherein the ultra high molecular weight polyethylene fibers, aramid fibers, polybenzobisoxazole fibers or combinations thereof are pre-stretched between the knots.

4. A device for protecting vehicles against rocket-propelled grenades (RPGs), comprising:

a netting of ultra high molecular weight polyethylene fibers, aramid fibers, polybenzobisoxazole fibers or combinations thereof that are knotted together and formed with a plurality of meshes having a stretched mesh length of maximally about 8 cm; and an element configured to dispose the netting at a distance of about 15-50 cm from a surface of the vehicle.

5. The device according to claim 4, wherein the stretched mesh length ranges between 7 cm and 8 cm.

6. The device according to claim 4, wherein material of the netting is pre-stretched after being knotted.

7. The device according to claim 4, wherein the meshes are formed by at least three mesh sides, each mesh side being made up of at least two separate fibers.

8. The device according to claim 4, wherein the meshes are provided with projections between the knots thereof.

9. The device according to claim 4 comprising two nettings disposed one behind the other.

10. The device according to claim 4, wherein each knot is a double knot.

11. The device of claim 4 and further comprising an armoured vehicle or vessel provided with armour plating and further comprising an element configured to dispose the netting of the device at a distance away from a surface of the vehicle or vessel.

12. The device according to claim 11, wherein the element comprises an air cushion disposed between the vehicle and the netting.

13. The device according to claim 12, wherein the air cushion is inflatable and comprises one or more sensors configured to detect an acute threat.

14. The device according to claim 11 wherein the element comprises a suspension device for the netting.

15. The device according to claim 11, wherein the element comprises foam material disposed between the vehicle and the netting.

* * * * *